United States Patent [19]

Zerbey

[11] 4,127,211

[45] Nov. 28, 1978

[54] DRINKING CUP AND SUPPORT

[75] Inventor: John E. Zerbey, Tylersport, Pa.

[73] Assignee: Product Research & Development Corporation, Tylersport, Pa.

[21] Appl. No.: 830,535

[22] Filed: Sep. 6, 1977

[51] Int. Cl.[2] ..... B65D 7/42; B65D 55/16

[52] U.S. Cl. ..... 220/212; 215/100 R; 220/69; 220/85 H; 220/375; 224/29 R; 248/346.1

[58] Field of Search ..... 220/300, 375, 69, 85 H, 220/212; 215/100 S, 100 R; 222/543; 24/208 A, 16 PB; 224/29 G, 29 R; 248/154, 311.1, 346.1

[56] References Cited

U.S. PATENT DOCUMENTS

| | | | |
|---|---|---|---|
| 370,239 | 9/1887 | Brombacher | 24/16 PB |
| 882,378 | 3/1908 | Friendlich | 220/69 |
| 1,351,964 | 9/1920 | Orofino | 220/300 |
| 2,155,759 | 4/1939 | Hocke | 222/543 |
| 2,361,506 | 10/1944 | Smith | 24/208 A |
| 2,781,148 | 2/1957 | Reddle | 220/300 |
| 2,950,847 | 8/1960 | Tapper | 222/543 |
| 2,997,199 | 8/1961 | Reachi | 220/69 |
| 3,526,335 | 9/1970 | Swett et al. | 220/69 |
| 3,598,271 | 8/1971 | Holley | 215/100.5 |
| 4,040,549 | 8/1977 | Sadler | 220/85 H |

FOREIGN PATENT DOCUMENTS

| | | | |
|---|---|---|---|
| 158,287 | 2/1921 | United Kingdom | 220/375 |

*Primary Examiner*—William Price
*Assistant Examiner*—Allan N. Shoap
*Attorney, Agent, or Firm*—Seidel, Gonda & Goldhammer

[57] ABSTRACT

A drinking cup and support are disclosed for use on movable vehicles wherein the cup is retained by and removably connected to a base secured to the vehicle. A lid on the upper end of the cup is removably connected to the cup handle for retention thereby.

7 Claims, 4 Drawing Figures

FIG. 1
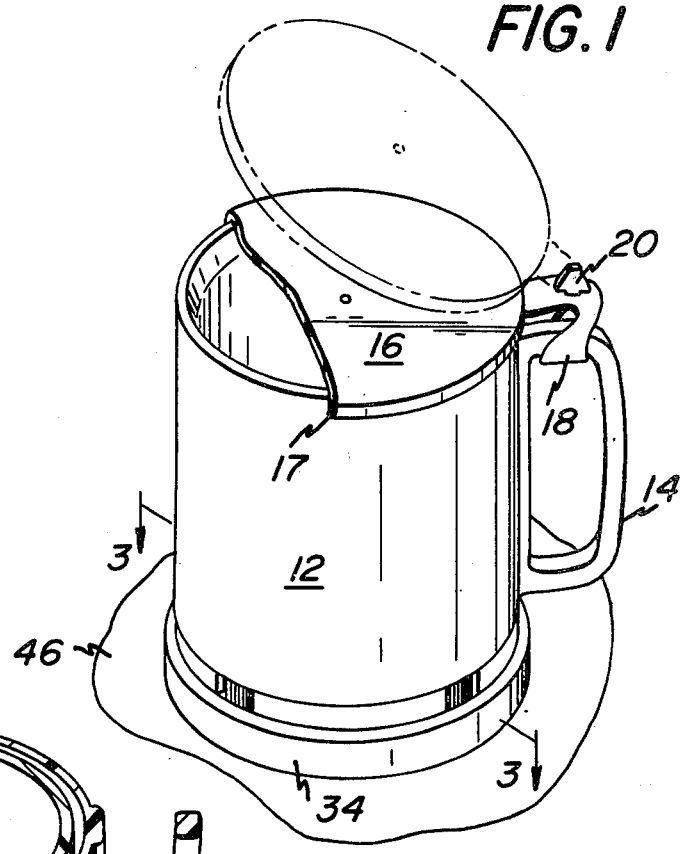
FIG. 4
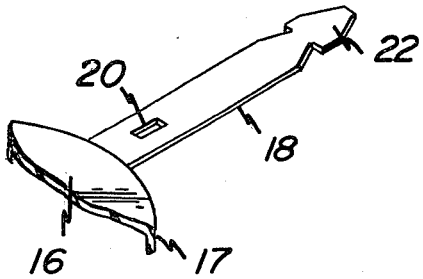
FIG. 2
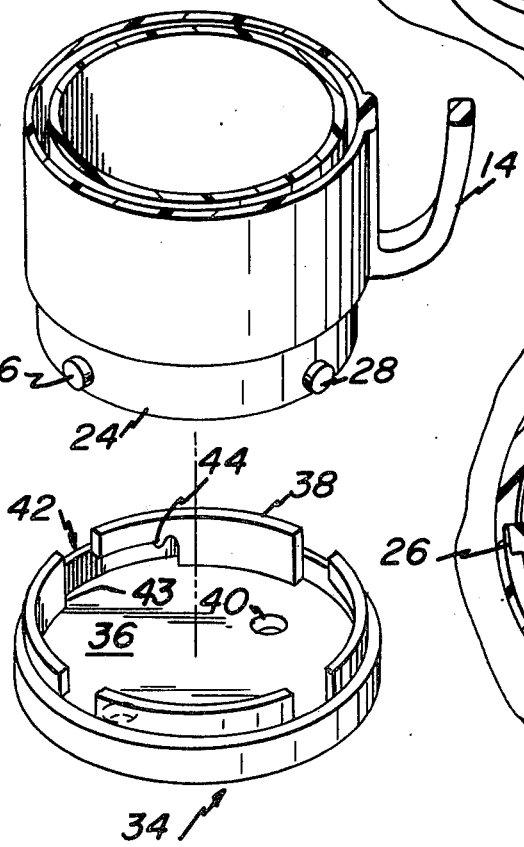
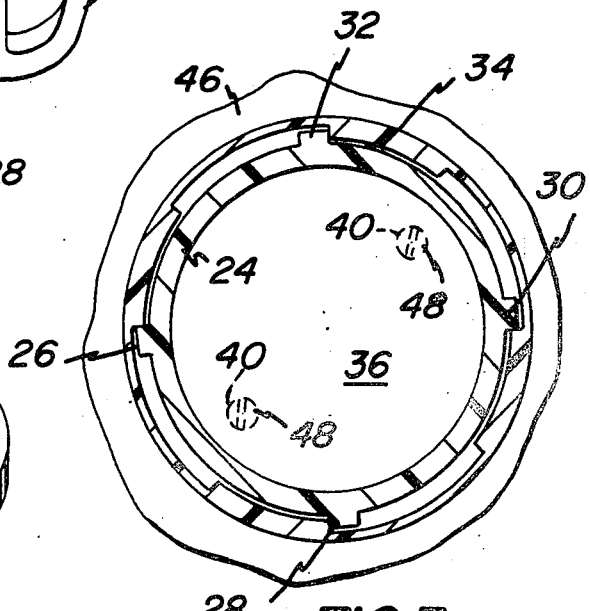
FIG. 3

DRINKING CUP AND SUPPORT

BACKGROUND

There is a need for a drinking cup and support which has universal application on various types of vehicles such as house trailers, automobiles, boats, trains, planes, etc. Various types of supports for drinking cups have been proposed heretofore but lack universal application. Another problem with the prior art is the lack of any means for permitting reuse of the lid when a beverage is not being consumed while at the same time providing the cup with a lid which facilitates manipulation with only one hand.

SUMMARY OF THE INVENTION

The present invention is directed to a drinking cup having a handle integral therewith. A lid is provided for the upper end of the cup. The lid has a means connecting the same to the handle so that the lid may be manually removed with one hand from the upper end of the cup and disposed to one side of the cup while being retained by the handle.

A means is provided for removably connecting the cup to a support including a plurality of radially disposed projections on the lower end of the cup. A base is provided and has means for fastening the base to a support. The base has an upstanding wall for receiving therein the lower end of the cup and contains bayonet slots. Each bayonet slot is adapted to receive one of the projections and each of said slots has a detent for retaining its projection therein to prevent inadvertent loosening of the cup with respect to the base due to any vibration of the support.

In addition to having universal application in various types of moving vehicles, the cup may be utilized with a plurality of bases. One base may be attached to a support such as a table or a dashboard of a vehicle while another base is attached to a shelf. The cup may be removably connected to the base on the shelf for purposes of storage when not in use. This is of particular advantage in connection with house trailers and the like. Since the lid is removably and adjustably retained by the handle of the cup, it may be reapplied to the upper end of the cup with the use of only one hand after a portion of the contents of the cup have been consumed. Thus, after a portion of the contents of the cup have been consumed, it is not necessary to search for the lid since the lid at all times remains with the cup unless intentionally removed from purposes of cleaning.

It is an object of the present invention to provide a drinking cup and support which has universal application, wherein the cup is provided with a lid retained thereby when a beverage is being consumed from the cup, while at the same time being simple, inexpensive, and reliable for use on vehicles subject to vibration.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a perspective view of a cup and support in accordance with the present invention.

FIG. 2 is an exploded view with the cup shown in section.

FIG. 3 is a sectional view taken along the line 3—3 in FIG. 1.

FIG. 4 is a partial perspective view of the lid and its integral tab.

Referring to the drawing in detail, wherein like numerals indicate like elements, there is shown a drinking cup and support in accordance with the present invention designated generally as 10.

The cup 12 may be of conventional construction with a double wall for purposes of insulation while being made of a lightweight non-corrosive, non-frangible material such as plastic. The cup 12 has an integral handle 14 and a removable lid 16. The lid 16 is preferably made from a plastic material with a downwardly extending flange 17 for frictionally embracing the upper end of the cup.

The lid 16 has an air hole in the center thereof and a tab 18 integral on one piece therewith and extending from the lower edge of the flange 17. Tab 18 terminates at its free end in a pointed tip 22. Tab 18 has an elongated slot 20. The lid 16 and tab 18 are made from a flexible plastic material having a thickness of about 1/32 inch so as to be sufficiently flexible whereby tab 18 may be bent back on itself with the pointed tip 20 extending through and retained by the slot 18. In this manner, the tab 18 forms a loop extending through the handle 14. When the lid 16 is manually removed, the loop defined by the tab 18 is slideable along the handle 14 whereby the lid 16 may be disposed to one side of the cup while being retained by the handle of the cup.

The cup 12 at its lower end is provided with a plurality of projections 26, 28, 30 and 32. For ease of manufacture, such projections extend radially outwardly from a ring 24 which may be separate from the cup 12 and attached thereto in any convenient manner such as by use of adhesives, welding or the like. The projections 28 are preferably cylindrical projections having a diameter of about 3/16 inch. The projections 26–32 are spaced from the lower edge of the ring 24.

The cup 12 is adapted to be retained in an upright or angularly disposed disposition by means of a base 34. A plurality of bases 34 may be provided whereof desired so that one base 34 may be utilized when the cup is in storage and another is utilized where a cup 12 is to be used for consuming a beverage therein.

The base 34 includes a bottom wall 36 having an upstanding peripheral wall 38. The wall 38 is provided with a plurality of bayonet slots 42. The number of bayonet slots 42 corresponds to the number of projections 26–32. Each bayonet slot 42 includes a detent 44 for frictionally retaining the cup 12 in a preset disposition with sufficient friction so as to minimize any tendency of the cup 12 from rotating with respect to the base 34 due to vibration. Also, a limit stop 43 is provided for contact by the projections at the removal position of the cup 12.

The base 34 has a plurality of holes 40 in the bottom wall 36 each adapted to receive a screw 48 for retaining the base 34 in a fixed position on a support surface 46. Support surface 46 may be a dashboard of a vehicle, a table, a shelf, or the like. The present invention may be utilized with the base 34 secured to the upper surface of a horizontal support 46, on the lower surface of a shelf, or on a vertical wall. Thus, cup 12 may be removed from a base 34 on a shelf, filled with a beverage to be consumed and removably connected to base 34 on a table.

Only one hand is needed to remove the lid 16 and cause it to be disposed to one side of the cup 12 while being retained by the loop defined by the tab 18. By means of the handle 14, the cup 12 may be removed from base 34 and a portion of its contents consumed. Thereafter, the cup 12 may be replaced on the base 34 on the table. Thereafter, the lid may be replaced so that the remainder of the contents of the cup 12 do not splash due to the vibration of the vehicle, to prevent foreign matter from entering the cup 12, etc. Lid 16 is removable for washing. Lid 16 can be moved to a position so that it is below cup 12 and acts as a coaster when cup 12 is not resting on base 34 and without disengaging the loop from handle 14.

The present invention may be embodied in other specific forms without departing from the spirit or essential attributes thereof and, accordingly, reference should be made to the appended claims, rather than to the foregoing specification as indicating the scope of the invention.

I claim:

1. Apparatus comprising a drinking cup having a handle, a plastic lid for the upper end of said cup, said lid having means connecting the same to said handle so that the lid may be manually removed from the upper end of the cup and disposed to one side of the cup while being retained by the handle, means for removably connecting said cup to a support, said means including a plurality of projections on the lower end of said cup, a base having means for fastening the same to a support, said base having means thereon for receiving the lower end of said cup, said base containing L-shaped bayonet slots, each of said bayonet slots being adapted to receive one of said projections, each of said bayonet slots having a detent for retaining a projection therein for minimizing a tendency of the cup to rotate relative to the base due to vibration of a support on which the base is attached, said handle having a generally vertical portion with ends connected to said cup, said means for connecting the lid to the handle being a tab integral in one piece with said lid, said tab being bent back on itself to form a loop about said handle, said loop slidable along the handle which it surrounds.

2. Apparatus in accordance with claim 1 wherein said tab having an opening therein spaced from a free end thereof, said tab at the free end thereof having a tip extending through and retained by said tab opening, an intermediate portion of said tab defining the loop slideable along said handle.

3. Apparatus in accordance with claim 2 wherein said lid has a downwardly extending flange embracing the outer periphery of the upper end of said cup, said tab being integral in one piece with a portion of said flange.

4. Apparatus in accordance with claim 1 wherein said base has a flat bottom wall and an upstanding side wall, said bayonet slots being in said side wall on said base, said projections being radially disposed with respect to said cup.

5. Apparatus in accordance with claim 4 wherein said flat bottom wall has a hole extending therethrough for receiving a fastener adapted to secure the base to a support surface.

6. Apparatus in accordance with claim 4 wherein each of said slots has a limit stop for said projections at the position where said cup is removable in a vertical direction from said base.

7. Apparatus in accordance with claim 1 wherein said loop is sufficiently long so that the lid may be used as a coaster when the cup is not resting on the base and while said loop is retained by said handle.

* * * * *